US009528333B2

(12) United States Patent
Ness

(10) Patent No.: US 9,528,333 B2
(45) Date of Patent: Dec. 27, 2016

(54) MIXING TANK AND METHOD OF USE

(76) Inventor: Danny Ness, Metairie, LA (US)

( * ) Notice: Subject to any disclaimer, the term of this patent is extended or adjusted under 35 U.S.C. 154(b) by 1145 days.

(21) Appl. No.: 12/948,517

(22) Filed: Nov. 17, 2010

(65) Prior Publication Data

US 2012/0073818 A1 Mar. 29, 2012

Related U.S. Application Data

(60) Provisional application No. 61/261,995, filed on Nov. 17, 2009.

(51) Int. Cl.
*E21B 21/06* (2006.01)

(52) U.S. Cl.
CPC ..... *E21B 21/062* (2013.01)

(58) Field of Classification Search
CPC .... E21B 21/062; E21B 21/065; E21B 21/066; E21B 21/067
USPC ..... 166/75.15, 90.1; 175/207, 217; 366/50, 366/157.1, 157.2, 157.3, 157.4, 186
See application file for complete search history.

(56) References Cited

U.S. PATENT DOCUMENTS 3,047,034 A * 7/1962 Sassmannshausen et al. ..... 141/311 R
3,183,553 A * 5/1965 Slater ..... 198/550.1
3,633,494 A * 1/1972 Schippers et al. ..... 222/408
4,585,353 A * 4/1986 Schonhausen ..... 366/11
4,690,804 A * 9/1987 Rohlfing ..... 422/219
4,741,843 A * 5/1988 Garvey et al. ..... 507/121
5,122,038 A * 6/1992 Malkoski ..... 417/313
5,426,137 A * 6/1995 Allen ..... 523/318
6,179,071 B1 * 1/2001 Dietzen ..... 175/66
6,585,115 B1 * 7/2003 Reddoch et al. ..... 209/3
7,493,969 B2 * 2/2009 Burnett et al. ..... 175/88
7,971,657 B2 * 7/2011 Hollier et al. ..... 175/66
8,419,266 B2 * 4/2013 Velayutham et al. ..... 366/2

* cited by examiner

*Primary Examiner* — Robert E Fuller
(74) *Attorney, Agent, or Firm* — Garvey, Smith, Nehrbass & North, L.L.C.; Charles C. Garvey, Jr.; Vanessa M. D'Souza

(57) ABSTRACT

A method of transmitting a fluid into an oil well bore provides a frame supporting a vessel, the vessel having an interior, upper and lower end portions, a conically shaped side wall, and an outlet for discharging the fluid from the vessel. A viscous polymeric material is added to the vessel interior. A discharge pipe having a vertical section is placed below the vessel, the discharge pipe being in communication with the outlet. A positive displacement pump is contained within the discharge pipe. The pump transmits fluid from the outlet into the discharge pipe downstream of the vertical pipe section or pump. The fluid is selectively transmitted to either the vessel interior (for recirculating) or into the well. Air is added to the discharge flow line downstream of the pump.

6 Claims, 1 Drawing Sheet

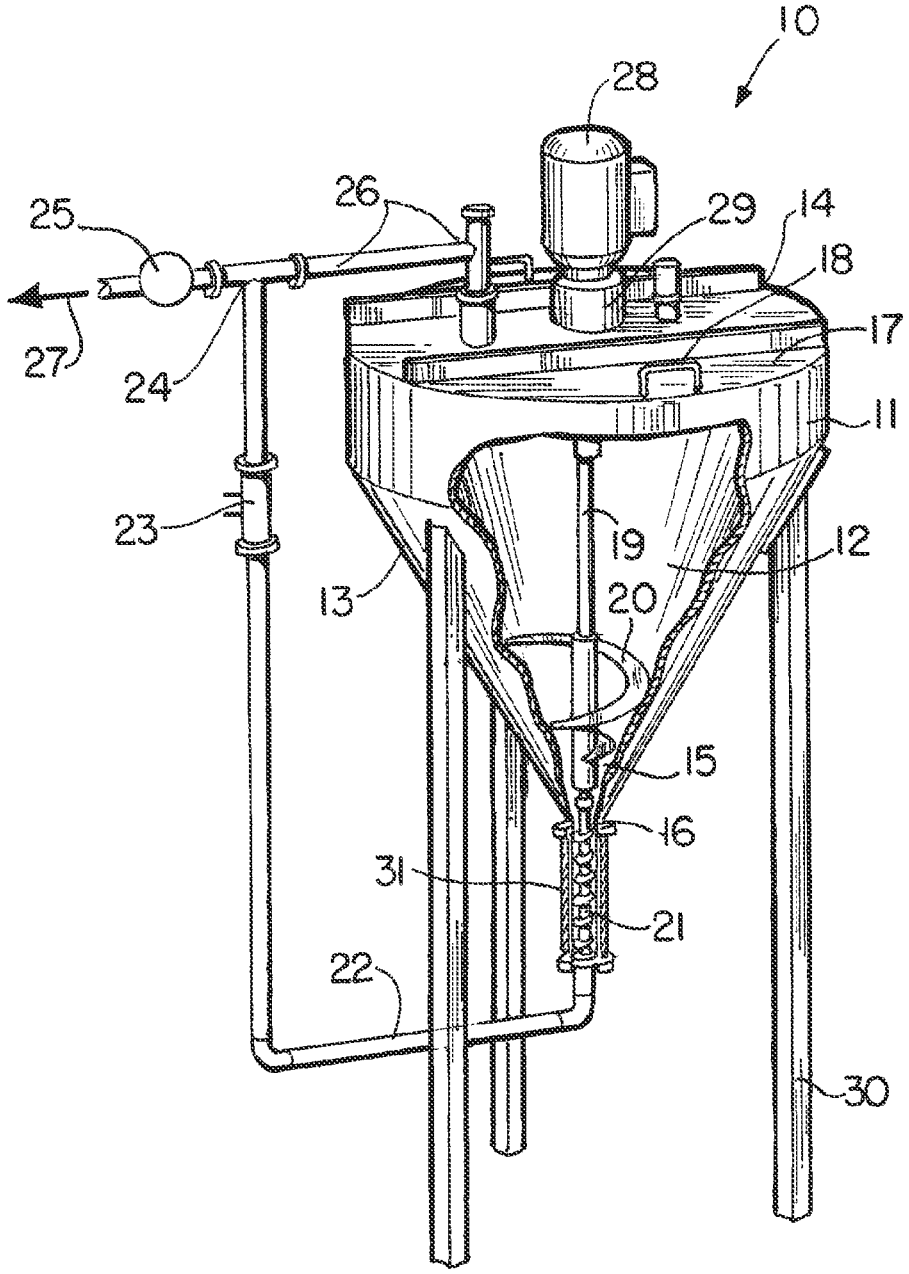
10
28
25
26
29
14
18
27
24
17
11
23
19
12
13
20
15
16
31
21
22
30

MIXING TANK AND METHOD OF USE

CROSS-REFERENCE TO RELATED APPLICATIONS

This is a nonprovisional of U.S. Provisional Patent Application Ser. No. 61/261,995, filed 17 Nov. 2009.

Priority of U.S. Provisional Patent Application Ser. No. 61/261,995, filed 17 Nov. 2009, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a specially configured mixing tank for mixing and transferring a liquid or slurry between into an oil well.

2. General Background

In the exploration of oil and gas in a marine environment, fixed, semi submersible, jack up, and other offshore marine platforms are used during drilling operations. Fixed platforms are typically used for production of oil and gas from wells after they have been drilled. Drilling and production require that specialized fluids and like supplies be transported from land based storage facilities to offshore platforms or drilling vessels. Supplies are typically transferred to offshore platforms using very large marine vessels called work boats. These work boats can be in excess of one hundred feet in length and have expansive deck areas for carrying cargo that is destined for an offshore platform. Supplies are typically transferred from a land based dock area to the marine vessel using a lifting device such as a crane or a mobile lifting and transport device such as a forklift.

Once a work boat arrives at a selected offshore platform, supplies or products are typically transferred from the deck of the work boat to the platform using a lifting device such as a crane.

Once on the deck of a drilling platform or production platform, space is at a premium. The storage of supplies on an offshore oil well drilling or production platform is a huge problem. Some specialized fluids used in the well require handling that does not shear the fluid. An example is a high viscosity fluid such as certain polymers. Many cargo transport and lifting devices have been patented. The table below lists some patents that relate generally to pallets, palletized racks, and other cargo racks.

TABLE 1

| PAT. NO. | TITLE | ISSUE DATE |
|---|---|---|
| 2,579,655 | Collapsible Container | Dec. 25, 1951 |
| 2,683,010 | Pallet and Spacer | Jul. 6, 1954 |
| 3,776,435 | Pallet | Dec. 4, 1973 |
| 3,916,803 | Loading Platform | Nov. 14, 1975 |
| 4,165,806 | Palletizing System for Produce Cartons and the Like | Aug. 28, 1979 |
| 4,403,556 | Drum Retainer | Sep. 13, 1983 |

TABLE 1-continued

| PAT. NO. | TITLE | ISSUE DATE |
|---|---|---|
| 4,828,311 | Metal Form Pallet | May 9, 1989 |
| 5,078,415 | Mobile Carrier for Gas Cylinders | Jan. 7, 1992 |
| 5,156,233 | Safety Anchor for Use with Slotted Beams | Oct. 20, 1992 |
| 5,292,012 | Tank Handling and Protection Structure | Mar. 8, 1994 |
| 5,507,237 | Lifting Apparatus for Use with Bulk Bags | Apr. 16, 1996 |
| 5,906,165 | Stackable Tray for Plants | May 25, 1999 |
| 6,058,852 | Equipment Skid | May 9, 2000 |
| 6,357,365 | Intermediate Bulk Container Lifting Rack | Mar. 19, 2002 |
| 6,371,299 | Crate Assembly and Improved Method | Apr. 16, 2002 |
| 6,422,405 | Adjustable Dunnage Rack | Jul. 23, 2002 |
| 6,668,735 | Pallet with a Plastic Platform | Dec. 30, 2003 |
| 6,725,783 | Pallet for Stacking Planographic Printing Plates Thereon | Apr. 27, 2004 |

BRIEF SUMMARY OF THE INVENTION

The present invention provides an improved mixer apparatus that includes a frame having upper and lower end portions. The frame supports a specially configured vessel and in internal mixer, pump and valving.

The present invention provides a method of transmitting a viscous polymeric fluid into an oil well bore. As part of the method, there is provided a frame supporting a vessel, the vessel having an interior, upper and lower end portions, a conically shaped side wall, and an outlet for discharging the fluid from the vessel.

A viscous material is added to the vessel interior.

A discharge pipe section is placed in communication with the outlet and at least in part below the vessel, the discharge pipe section being in communication with the outlet.

A positive displacement pump is placed in the discharge pipe section, the pump transmitting the fluid from the outlet into the discharge pipe downstream of the vertical pipe section.

There can be a selective transmitting of the fluid to either the vessel interior for recirculating or into the well.

Air can be added to the discharge flow line downstream of the pump.

In one embodiment, the pump includes screw conveyor.

In one embodiment, the conically shaped side wall extends to the outlet and placing the positive displacement pump entirely below the conically shaped side wall.

In one embodiment, the viscous polymeric material includes a fluid loss control product.

In one embodiment, the viscous material is a viscous polymeric material.

In one embodiment, the vessel gradually tapers downwardly to provide a larger upper portion and a smaller lower portion.

In one embodiment, a drive shaft rotates an auger that is inside the vessel.

In one embodiment, the drive shaft rotates both the screw conveyor and the auger.

In one embodiment, the pump includes a drive shaft that rotates the screw conveyor.

The present invention provides in one embodiment, a method of transmitting a viscous polymeric fluid into an oil well bore.

The method includes providing a frame supporting a vessel, the vessel having an interior, upper and lower end portions, a conically shaped side wall that tapers downwardly, and an outlet for discharging the fluid from the vessel.

The method includes adding a polymeric material to the vessel interior that is a fluid loss control product.

A discharge pipe section is placed below the vessel, the discharge pipe section being in communication with the outlet;

A positive displacement pump is placed in the discharge pipe, the pump transmitting the fluid from the outlet into the discharge pipe downstream of the vertical pipe section.

The fluid can be transmitted to either the vessel interior for recirculating or into the well.

In one embodiment, the pump has a drive shaft and the drive shaft extends into the vessel interior.

In one embodiment, the pump includes screw conveyor.

In one embodiment, the conically shaped side wall extends to the outlet and placing the positive displacement pump entirely below the conically shaped side wall.

In one embodiment, the viscous material is a viscous polymeric material.

In one embodiment, air can be added (e.g. injected) to the discharge pipe section downstream of the outlet.

In one embodiment, the vessel gradually tapers downwardly to provide a larger upper portion and a smaller lower portion.

In one embodiment, a drive shaft rotates an auger that is inside the vessel.

In one embodiment, the drive shaft rotates both the screw conveyor and the auger.

In one embodiment, the pump includes a drive shaft that rotates the screw conveyor.

The present invention provides an apparatus for transmitting a viscous polymeric fluid into an oil well bore, comprising:

The apparatus includes a frame that supports a vessel, the vessel having an interior, upper and lower end portions, a conically shaped side wall, and an outlet for discharging the fluid from the vessel.

An opening in the vessel enables the addition of a viscous material to the vessel interior.

A discharge pipe section is in communication with the outlet and extending at least in part below the vessel, the discharge pipe section being in communication with the outlet.

A positive displacement pump is placed in the discharge pipe section, the pump transmitting the fluid from the outlet into the discharge pipe downstream of the vertical pipe section.

Piping enables selective transmission of the fluid to either: 1) the vessel interior for recirculating, or 2) into the well.

A source of air includes and air inlet fitting for enabling air to be added to the discharge flow line downstream of the pump.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 1 is an elevation view of the preferred embodiment of the apparatus of the present invention.

DETAILED DESCRIPTION OF THE INVENTION

FIG. 1 shows the preferred embodiment of the apparatus of the present invention designated generally by the numeral 10. Mixing apparatus 10 and its method contemplate the addition of a viscous and/or polymeric fluid into the well bore of an oil/gas well as part of well control. Such products can include fluid loss control products such as for example "Safe-Link" from MiSwaco (www.miswaco.com). In FIG. 1, a vessel 11 is provided, supported upon frame or legs 30. Vessel 11 has interior 12. Vessel 11 has a tapered wall or cone 13. Vessel 11 has a larger upper end portion 14 and smaller lower end portion 15 due to the conical shape of the side wall or cone 13. The lower end portion 15 has an outlet which enables fluid to be discharged from vessel 11 interior 12.

A lid or cover 17 is provided on upper end portion of vessel 11. Lid or cover 17 can be hingedly mounted upon upper end portion 14 of vessel 11. Handle 18 on lid or cover 17 enables a user to open or close the vessel 11 such as when adding fluid to vessel interior 12. A drive shaft 19 rotates auger 20. The drive shaft 19 can also rotate screw conveyor 21 or a positive displacement pump. The screw conveyor 21 or positive displacement pump can be contained within a vertical section 31 of discharge piping 22. Air is preferably added to discharge piping 22 such as via air injector or air inlet 23.

Valve 24 is a directional valve that enables fluid to be either recirculated back to vessel 11 are transmitted into an oil well bore. In FIG. 1, flow line 26 is a recirculation flow line that transmits fluid from valve 24 to vessel 11 interior 12. FIG. 1 also illustrates transfer of fluid from valve 24 into a well bore as indicated schematically by the numeral 27. Valve 24 can be operated to send flow to either vessel 11 or to the well bore using an operator 25.

The following is a list of suitable parts and materials for the various elements of the preferred embodiment of the present invention.

PARTS LIST

| PART NO. | DESCRIPTION |
|---|---|
| 10 | mixer apparatus |
| 11 | vessel |
| 12 | vessel interior |
| 13 | cone/tapered wall |
| 14 | upper end portion |
| 15 | lower end portion |
| 16 | outlet |
| 17 | lid/cover |
| 18 | handle |
| 19 | drive shaft |
| 20 | auger |
| 21 | screw conveyor/positive displacement pump |
| 22 | discharge pipe |
| 23 | air injector/air inlet |
| 24 | valve |
| 25 | operator |
| 26 | return flow line |
| 27 | arrow - flow to well |
| 28 | motor |
| 29 | gear box |
| 30 | frame/legs |
| 31 | vertical section |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of transmitting a polymeric material into an oil well bore, comprising the steps of:

a) providing a frame supporting a vessel, the vessel having an interior, upper and lower end portions, a conically shaped side wall, and a vessel outlet below said conically shaped side wall for discharging the material from the vessel;

b) adding the polymeric material to the vessel interior;

c) placing a discharge pipe section in communication with the outlet and extending at least in part below the vessel;

d) placing a pump in the discharge pipe section below the outlet, said pump transmitting the material from the outlet into the discharge pipe downstream of a vertical pipe section of the discharge pipe section;

e) selectively transmitting the polymeric material to either the vessel interior for recirculating or into the well via first and second flow lines, the first flow line discharging into the vessel, the second flow line transmitting the polymeric material to the well; and f) wherein the pump includes a drive shaft that is at least partially contained within the vessel interior; and g) an auger on the drive shaft and contained within the vessel and above the outlet, the drive shaft extending to the outlet and rotating both the auger and the pump mounted on the drive shaft about a common rotational axis.

2. The method of claim 1 wherein in step "d" the pump includes a screw conveyor.

3. The method of claim 1 wherein the conically shaped side wall extends to the outlet and at least part of the pump is positioned below the conically shaped side wall.

4. The method of claim 1 wherein in step "b" the polymeric material includes a fluid loss control product.

5. The method of claim 1 wherein the polymeric material is a viscous polymeric material.

6. The method of claim 1 wherein the vessel gradually tapers downwardly to provide a larger upper portion and a smaller lower portion.

* * * * *